US006202864B1

(12) United States Patent
Ernst et al.

(10) Patent No.: US 6,202,864 B1
(45) Date of Patent: Mar. 20, 2001

(54) LOCK SECURING ELONGATE ARTICLES TO A HOLDER

(76) Inventors: Gregory R. Ernst, 15735 SE. Bartell Rd., Boring, OR (US) 97009; Dylan G. Ernst, 35045 SE. Clover Dr., Estacada, OR (US) 97023

( * ) Notice: Subject to any disclaimer, the term of this patent is extended or adjusted under 35 U.S.C. 154(b) by 0 days.

(21) Appl. No.: 09/264,245

(22) Filed: Mar. 8, 1999

(51) Int. Cl.[7] ..... A47F 5/00
(52) U.S. Cl. ..... 211/70.6; 206/372; 206/376
(58) Field of Search ..... 211/70.6, 70.7; 206/376, 372, 373

(56) References Cited

U.S. PATENT DOCUMENTS 2,119,217 * 5/1938 Rocchi .
4,911,297 * 3/1990 Saburu ..... 206/376
5,036,975 * 8/1991 Chow ..... 206/376
5,346,063 * 9/1994 Chow ..... 211/70.6 X
5,505,316 * 4/1996 Lee ..... 211/70.6
5,598,924 * 2/1997 McCann ..... 206/372

* cited by examiner

*Primary Examiner*—Robert W. Gibson, Jr.
(74) *Attorney, Agent, or Firm*—James D. Givnan, Jr.

(57) ABSTRACT

A lock for the retention of articles such as box wrenches supported in place on a holder and including a barrier closely overlying the articles. Posts on the barrier include flexible segments for insertion into openings for locked engagement with the holder to retain the barrier in proximate the articles to prevent article removal from the holder. The flexible segments may be fractured by a purchaser for access to and removal of the articles.

6 Claims, 1 Drawing Sheet

LOCK SECURING ELONGATE ARTICLES TO A HOLDER

BACKGROUND OF THE INVENTION

The present invention pertains generally to racks or holders on which hand tools and other articles are displayed or stored with such holders oftimes being used for displaying the tools in a retail establishment.

It is common practice in the marketing of hand tools to display articles such as a set of wrenches, screwdrivers, etc., supported in place on a holder with the holder being useable thereafter for orderly tool storage. A problem exists in displaying of hand tools, some being of considerable cost, in retail establishments in that some tool holders permit tool removal and concealment permitting theft of the tool. In an attempt to thwart such theft some tool manufacturers have resorted to shrink wrapping or the bubble packaging of tools but have found that such packaging is costly. Further, such packaging may or may not include a useable holder for later use by the purchaser for orderly storage of the tools. A further drawback is that such packaging prevents a prospective purchaser from closely examining the tools resulting in loss of a sale by the retailer. It is important in the merchandising of tools that the same be displayed for view by the prospective buyer. The theft of tools from store shelves and racks constitutes a problem for most retail establishments as tools are typically highly portable and readily concealable.

SUMMARY OF THE INVENTION

The present invention pertains to a lock conveniently, but securely, attachable to a tool holder to prevent theft of a hand tool or tools therefrom.

The present lock is highly adaptable for use with known tool racks or holders to securely lock each tool against separation from its rack or holder which requires access to the back side of the holder and the use of a tool to fracture portions of the lock. Display of the article or tool is not detracted from by the present lock. Further the rack need not be modified to cooperate with the present lock* other than the formation of apertures therein during manufacture of the holder. Assembly of a tool holder with a set of tools or other elongate articles in place thereon is accomplished by the addition of the present lock simply by downward insertion of lock components through openings in the holder.

DETAILED DESCRIPTION OF THE PREFERRED EMBODIMENTS

Figure 1:
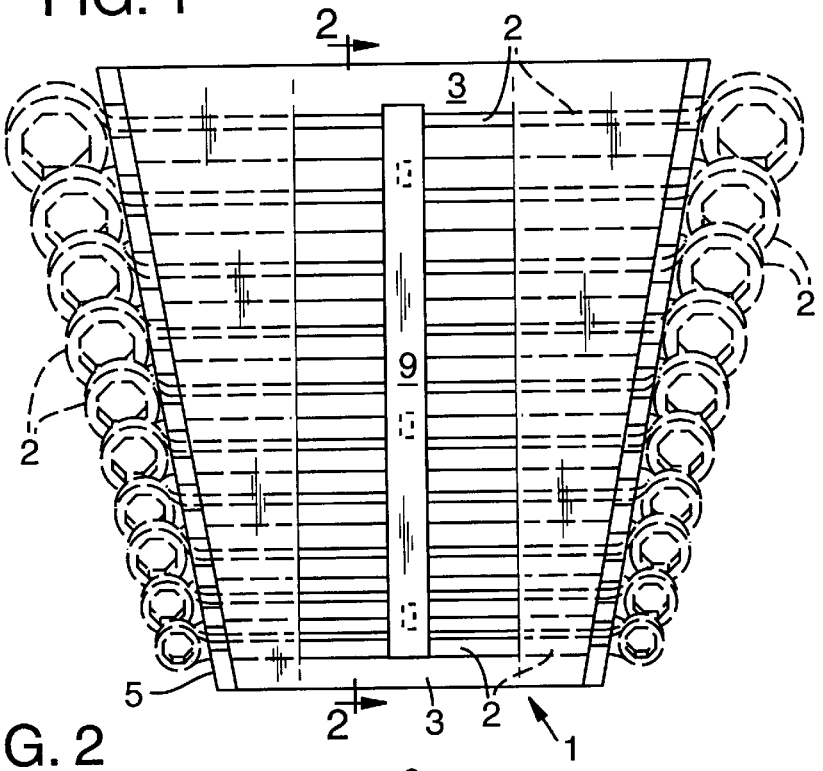
FIG. 1 is a plan view of a tool holder with the present lock in place.

With continuing attention to the drawings, the reference numeral 1 indicates generally a holder on which a product such as hand tools at 2 may be supported in orderly spaced apart fashion.

A back wall 3 of the holder defines openings as at 4 (FIG. 2) while raised supports or rails at 5 on the back wall receive the tools 2, shown as hand wrenches, or other articles. Preferably, for tool supporting purposes the supports 5 define a series of recesses 6 to receive the stored articles in inserted fashion. Holders, as above noted, are used in the packaging and sale of hand tools. Each support 5 preferably includes a tool biasing member 7 which flexes upon tool insertion into a recess 6.

Indicated at 9 is a barrier of a tool lock elongate to closely overly the tools or other articles in place on the holder to prevent same from being extracted out of holder recesses 6.

Retention means for barrier 9 includes one or more posts 11 having a flexible segment 12 with sloped end surfaces 13 facilitating insertion of the segment through holder wall apertures 4. A slot 14 contributes to end segment flexibility. Subsequent to end segment insertion, edges at 15 prevent post extraction from the holder.

Figure 2:
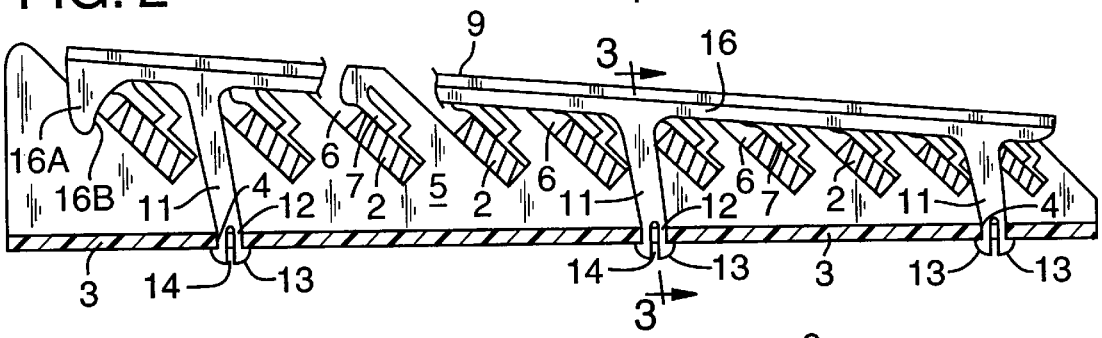
FIG. 2 is a sectional view taken along line 2—2 of FIG. 1.
Figure 4:
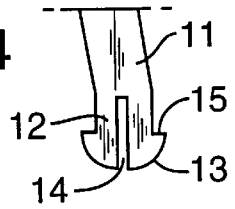
FIG. 4 is an enlarged fragmentary view of a post of the present lock.
Figure 3:
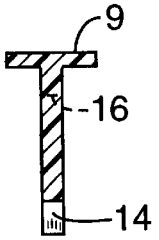
FIG. 3 is a sectional view taken along line 3—3 of FIG. 2.

In instances where the tools or other articles stored on the holder are not of uniform size the barrier 9 may be out-of-parallel, as shown in FIG. 2, with the holder back wall in which case the posts may include angulated segments 12 for desired perpendicular relationship to the holder back wall. Depending on the articles or tools in place on the holder it may be desirable to provide posts 11 in canted relationship to barrier 9 for insertion between the articles during barrier installation.

With attention again to barrier 9, the same preferably includes a rib 16 which is shaped to provide an optimum or close relationship with the holder supported articles to block and prevent extraction regardless of the direction of the attempted removal, i.e., either laterally or lengthwise in the case of elongate hand tools such as wrenches. A tang at 16A on the rib has inclined surfaces 16B to further hinder tool removal.

Upon purchase of the holder supported tools, the buyer may remove the lock by fracturing of the post ends with pliers or, if desired, retain the lock intact by compression of the flexible end segment for removal from the holder.

While we have shown but one embodiment of the invention, it will be apparent to those skilled in the art that the invention may be embodied still otherwise without departing from the spirit and scope of the invention.

Having thus described the invention, what is claimed and desired to be secured by a Letters Patent is:

1. A lock for attachment to a holder of multiple elongate articles said holder having an aperture therein, said lock comprising, a barrier for overlying placement on the articles, said barrier having a rib, and retention means carried by said barrier including a post having a flexible segment for insertion through the aperture and locking engagement with the holder, said flexible segment defining a slot, surfaces on said segment being inclined to the major axis of the post facilitating insertion of the segment through the holder aperture, edges on said segment engageable with said holder when said segment is in an inserted unbiased condition to prevent segment extraction from the holder.

2. The lock claimed in claim 1 wherein said barrier is elongate.

3. The lock claimed in claim 1 wherein said retention means comprises multiple posts integral with said barrier and spaced therealong.

4. The lock claimed in claim 1 wherein said flexible segment is of frangible construction.

5. The lock claimed in claim 1 wherein said barrier includes a rib integral with said retention means.

6. The lock claimed in claim 4 wherein said barrier has a tang with surfaces inclined to the rib axis to enhance confinement of holder mounted articles.

* * * * *